US005270486A

United States Patent [19]

Chan et al.

[11] Patent Number: 5,270,486

[45] Date of Patent: Dec. 14, 1993

[54] METALLIC TRANSMISSION MEDIUM DISPOSED IN STABILIZED PLASTIC INSULATION

[75] Inventors: Maureen G. Chan, New Providence, N.J.; Kent B. Connole, Columbus, Ohio; Timothy S. Dougherty; Karen D. Dye, both of Phoenix, Ariz.; Stanley Kaufman, Dunwoody, Ga.; Valerie J. Kuck, Upper Montclair, N.J.; Leonard D. Loan, deceased, late of New Providence, N.J., by Grace I. Loan, executor; Edward D. Nelson, Stone Mountain, Ga.; Raffaele A. Sabia, Marlboro, N.J.

[73] Assignee: AT&T Bell Laboratories, Murray Hill, N.J.

[21] Appl. No.: 891,351

[22] Filed: May 29, 1992

[51] Int. Cl.[5] ..... H01B 7/28

[52] U.S. Cl. ..... 174/23 R; 174/107; 174/120 R; 174/120 SR

[58] Field of Search ..... 174/120 R, 120 SR, 23 R, 174/23 C, 107, 110 F, 110 PM

[56] References Cited

U.S. PATENT DOCUMENTS

| | | | |
|---|---|---|---|
| 3,668,298 | 6/1972 | Hawkins | 174/23 C |
| 3,717,716 | 2/1973 | Biskeborn et al. | 174/25 R |
| 3,901,849 | 8/1975 | Dodson et al. | 260/45.8 NW |
| 4,058,669 | 11/1977 | Nutt et al. | 174/110 F X |
| 4,073,771 | 2/1978 | Hartless et al. | 174/110 PM X |
| 4,319,071 | 3/1982 | Schmidt | 174/23 C |
| 4,412,094 | 10/1983 | Dougherty et al. | 174/110 F |
| 4,464,013 | 8/1984 | Sabia | 174/25 C X |
| 4,711,811 | 12/1987 | Randa | 174/110 F X |
| 4,870,117 | 9/1989 | Levy | 174/23 R X |

FOREIGN PATENT DOCUMENTS

| | | | |
|---|---|---|---|
| 952991 | 8/1974 | Canada | 174/23 R |

OTHER PUBLICATIONS

Chan, et al., "Stabilization Of Foamed Polyethylene Communication Cable Over Copper Conductors", Int'l. Conf. on Advances in the Stabilization and Degradation of Polymers, May 22-24, 1991.

Pospisil, et al., "Oxidation Inhibition in Organic Materials, METAL DEACTIVATORS," vol. 1, pp. 226-246, CRC Press, Inc. 1990.

Bowmer, et al., "Thermal Stability Tests For Polyolefin Insulations", 39th INTERNATIONAL WIRE AND CABLE SYMPOSIUM, Nov. 13-15, 1990.

Bowmer, "Cracking of Foam-Skin Polyethylene Insulations In Pedestals", 37th INTERNATIONAL WIRE AND CABLE SYMPOSIUM, Nov. 15-17, 1988.

Brown, "Performance of HDPE Insulation Antioxidants in Filled Telephone Cable Applications", 36th INTERNATIONAL WIRE AND CABLE SYMPOSIUM, Nov. 17-19, 1987.

*Primary Examiner*—Morris H. Nimmo

*Attorney, Agent, or Firm*—Edward W. Somers

[57] ABSTRACT

An insulated conductor (20) for use in a communication cable which includes a filling material (30) includes a copper conductor (25) and a composite insulation system (27) comprising two concentric layers of insulation. An inner foam layer (28) of the insulation comprises a cellular plastic material (28) which includes a stabilizer system. An outer layer (29) of the insulation is referred to as a skin and comprises a stabilized solid plastic material. The stabilizer system in each of the cellular and solid layers includes a bifunctional portion that functions as an antioxidant and as a metal deactivator and that has a relatively high resistance to extraction. The level of the bifunctional portion of the stabilizer in the cellular material is substantially greater than that in the skin inasmuch as it has been found that the level of the stabilizer cellular layer contiguous to the copper wire determines the oxidation performance level of the composite insulation.

21 Claims, 3 Drawing Sheets

% 1024 VS. AGING
26 AWG DEPIC

OIT VS. AVERAGE % 1024
26 AWG DEPIC

METALLIC TRANSMISSION MEDIUM DISPOSED IN STABILIZED PLASTIC INSULATION

TECHNICAL FIELD

This invention relates to a metallic transmission medium disposed in a stabilized plastic insulation. More particularly, a copper transmission medium is disposed in superimposed layers of cellular and solid stabilized plastic insulation materials in which the weight percent of a stabilizing system in the cellular material is substantially greater than that used in the solid material and substantially greater than has been used in the prior art to provide enhanced protection for the insulation, especially when the conductors are contacted by cable filling materials.

BACKGROUND OF THE INVENTION

As is well known, metallic conductor transmission media have been used widely in communications. Such media typically include a plurality of twisted pairs of insulated conductors which comprise a core. Each insulated conductor typically includes a metallic conductor having a layer of an insulation material thereabout. The core typically is enclosed in a sheath system which includes at least a plastic jacket.

Although over the last decade, optical fiber transmission has enjoyed a spectacular climb in use, metallic conductors continue to be used. However, in such a competitive environment, it behooves any manufacturer of cables which include insulated metallic conductors, to overcome any problems which have manifested themselves.

One such problem relates to an insulation system which is used to enclose each metallic conductor. Typically, that insulation system comprises an inner layer of a cellular or expanded insulation whereas an outer layer comprises a solid insulation material. In many instances, the insulation material is a composition which comprises a polyolefin plastic material, and, more particularly, a polyethylene plastic material and a stabilization system.

Such insulation material has been found to possess excellent mechanical and electrical properties. However, it also has been determined that the relatively low thermal stability of polyolefins may lead to a problem after long term use. Unless this problem is addressed, the insulation material may crack where exposed to relatively high temperatures. Such temperatures may occur, for example, in areas of the southwestern portions of the United States. The cracking of conductor insulation occurs when portions of insulated conductors of aerial or buried cables become exposed to air in splicing environments such as in closures, for example.

There is some thought that the lack of thermal stability may be caused by the extraction of constituents of a stabilization system of the insulation composition by filling materials which are used widely in communications cables. Further, it has been shown that an adverse reaction occurs between the surface of a copper conductor and the stabilization system of the insulation material. As a result, the copper of the metallic conductor catalyzes the oxidation of the polyethylene insulation which then deteriorates at an accelerated rate. Copper catalyzed oxidation of polyolefin insulation leads to the premature failure of communications cables.

The stabilization of cellular insulation over copper conductors has been discussed in an article authored by M. G. Chan, V. J. Kuck, F. C. Schilling, K. D. Dye and L. D. Loan entitled "Stabilization of Foamed Polyethylene Communication Cable Over Copper Conductors" which appeared in the proceedings of the Thirteenth Annual International Conference on Advances In The Stabilization and Degradation of Polymers held in Luzern, Switzerland on May 22-24, 1991.

Manufacturers have addressed the problem of stabilization, and, as a solution, have included in the composition of the insulation material an antioxidant and a metal deactivator. See, U.S. Pat. No. 3,668,298 which issued on Jun. 6, 1972 in the name of W. L. Hawkins. Further, more recently, the levels of antioxidant and of metal deactivator constituents in the insulation composition have been increased. However, it was believed that there were certain outer limits of the amount of stabilizer the should be used. For example, it was believed that the addition of stabilizer including antioxidant and metal deactivator functions at a level of about 0.25% by weight would satisfy all the requirements for long term use.

What is sought after and what appears not to be available in the prior art is a cable which includes a conductor insulated with a polyolefin composition which has sufficient thermal stability to cause the integrity of metallic conductor insulation to be maintained over a relatively long period of time as predicted by currently used tests. The sought-after composition desirably should be reasonable in cost and easily applied to a metallic conductor without the need of additional capital investment.

SUMMARY OF THE INVENTION

The foregoing problems of the prior art have been overcome by a cable which includes a transmission medium disposed in an insulation system. The insulation system includes an inner layer of a cellular plastic material and an outer layer comprising a solid plastic material.

Each of the layers of the insulation system is stabilized with a system which includes an antioxidant function and a metal deactivator function and which includes at least a portion having a relatively high resistance to extraction by cable filling materials. Advantageously, the weight percent of the stabilizer in the layer of cellular material is substantially greater than in that of the solid insulation. As a result of the highly stabilized cellular material being contiguous to the transmission medium which typically is a copper strand, the degradation of the insulation with respect to time is greatly reduced.

The foregoing insulated conductor is included in a cable which includes a filling material which contacts the insulated conductors and a sheath system.

BRIEF DESCRIPTION OF THE DRAWING

Other features of the present invention will be more readily understood from the following detailed description of specific embodiments thereof when read in conjunction with the accompanying drawings, in which.

DETAILED DESCRIPTION

Figure 1:
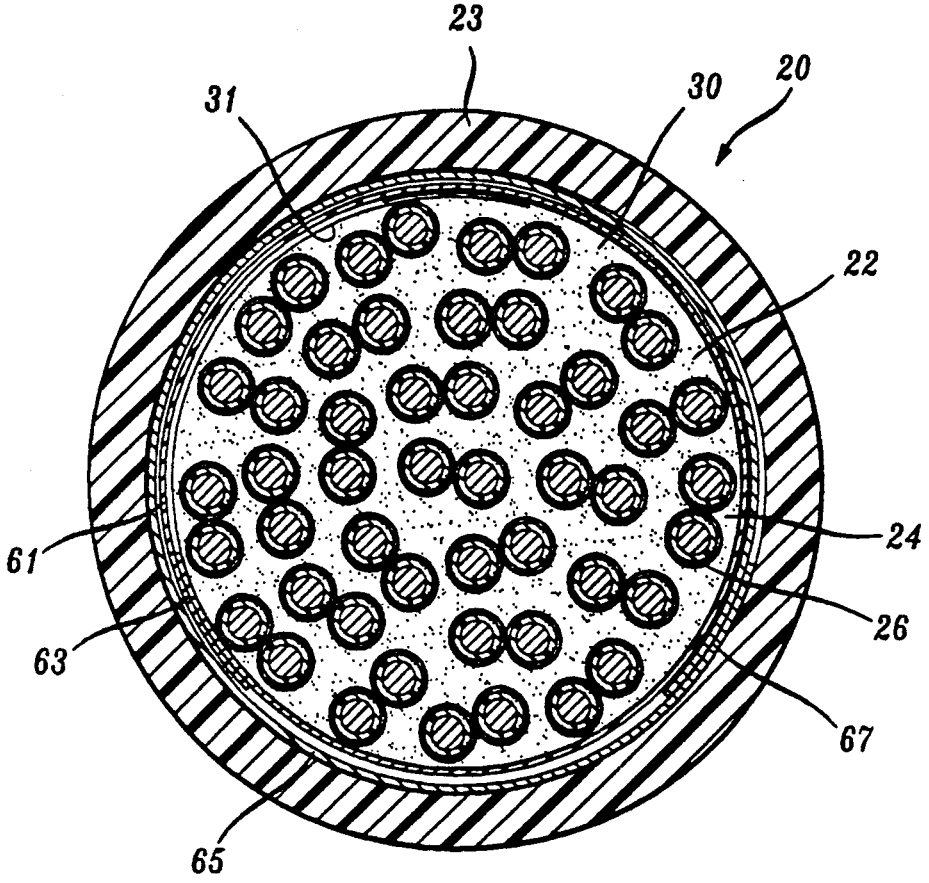
FIG. 1 is an end sectional view of a cable which includes a core comprising a plurality of plastic insulated conductors and a sheath system.

Referring now to FIG. 1, there is shown a communications cable which is designated generally by the numeral 20. The cable 20 includes a core 22 and a sheath system which includes a jacket 23.

Figure 2:
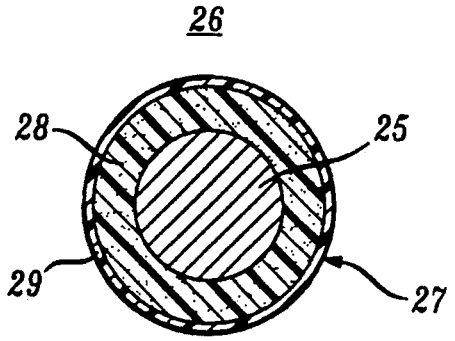
FIG. 2 is an end view of an insulated conductor having two stabilized concentric layers of insulation, an inner one of the layers being an expanded plastic material and referred to as a foam layer and an outer one of the layers being referred to as a skin.

The core 22 includes a plurality of pairs 24—24 of plastic insulated metallic conductors 26—26. Each of the insulated conductors 26—26 (see FIG. 2) includes a metallic conductor 25, which typically is copper, and an insulation system 27.

The insulation system 27 comprises two layers, an inner layer 28 comprising an expanded plastic material, also termed a cellular plastic material. The layer 28 is often referred to as the foam layer. The plastic material of the inner layer is a composition of matter comprising a polyolefin plastic material, a blowing agent, and a stabilization system. Typically, the polyolefin plastic material is polyethylene.

The inner layer comprises a polyolefin such as polyethylene which has been expanded by a chemical blowing agent. Although others may be used, a preferred blowing agent is azodicarbonamide. The chemical structure of same is as follows:

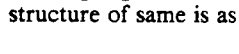

$$H_2N—CO—N{=}N—CO—NH_2.$$

During the insulating process, the blowing agent is decomposed to provide gas. The final insulation layer 28 includes decomposition products of the blowing agent.

The insulation system 27 also includes an outer layer 29. The outer layer 29 which often is referred to as the skin layer comprises a solid plastic material such as polyethylene, a stabilization system and a colorant material. For 26 AWG copper wire, the diameter of the metallic conductor is 0.016 inch and the outer diameter of the insulated conductor is about 0.029 inch. The outer skin layer has a thickness of about 0.002 inch. The quantity of plastic material per unit length of the inner layer is substantially equal to that of the outer layer. Preferably, the plastic material of the inner layer and of the skin is a polyolefin such as high density polyethylene or polypropylene, for example. The foregoing insulated conductor often has been referred to as DEPIC which is an acronym for dual expanded polyethylene insulated conductor.

Disposed within the core is a filling material 30. One such filling material is a Flexgel filling material. Flexgel is a registered trademark of AT&T. A suitable filling material is disclosed in U.S. Pat. No. 4,464,013 which issued on Aug. 7, 1984, in the name of R. Sabia. Another filling material is disclosed in U.S. Pat. No. 4,870,117 which issued on Sep. 26, 1989, in the names of A. C. Levy and C. F. Tu. Still another filling material is one comprising polyethylene and petrolatum, typically referred to as PE/PJ. See U.S. Pat. No. 3,717,716 which issued on Feb. 20, 1973 in the names of M. C. Biskeborn, J. P. McCann, and R. A. Sabia. The filling material, which also is stabilized, becomes disposed in interstices among the conductors and between the conductors and a tubular member 31, which typically is referred to as the core wrap.

Each layer of conductor insulation is provided with a stabilizer system which includes an antioxidant function and a metal deactivator function and includes a portion which has a relatively high resistance to extraction by filling materials. By antioxidant is meant a chain terminator and/or a peroxide decomposer. By a metal deactivator is meant that which chelates metal ions. In the prior art, stabilization systems for polyolefins in metallic conductor insulation have included a combination of an antioxidant such as, for example, a sterically hindered phenol and a metal deactivator.

In the preferred embodiment, each layer of insulation includes Ciba Geigy Irganox® 1010 and Irganox MD 1024 stabilizers, the latter being bifunctional and functioning both as a metal deactivator and an antioxidant. The chemical name as used in the Code of Federal Regulations for Irganox 1010 is tetrakis [methylene (3,5-di-tert-butyl-4-hydroxy-hydrocinnamate)] methane. The CAS name for the latter is 2,2-bis[[3-[3,5-bis(1,1 dimethylethyl)-4-hydroxy phenyl]-1-oxopropoxy]methyl]-1,3-propanoate propanediyl 3,5-bis(1,1-dimethylethyl)-4-hydroxybenzene. On the other hand, the chemical name for Irganox MD 1024 is N'N'-bis [3-(3',5'di-tert-butyl-4-hydroxy-phenyl) propanyl-hydrazine. The CAS name for 1024 is 3,5-bis(1,1-Dimethylethyl)-4-hydroxy-benzenepropanoic acid2-[3-[3,5-bis-(1,1dimethylethyl)-4-hydroxy-phenyl-1-oxopropyl] hydrazide.

The Irganox 1010 stabilizer is relatively extractable. On the other hand, the bifunctional Irganox 1024 stabilizer has a relatively high resistance to extraction. Typically, each of the inner and outer layers of insulation includes 0.15% by weight of the Irganox 1010 stabilizer. The weight percent of the bifunctional stabilizer is discussed hereinafter.

Oxidative cracking can occur in either insulation layer and must be retarded. The oxidation of the insulation can be catalyzed by the copper conductor which is contiguous to the cellular layer. A stabilizer system which may include antioxidant/metal deactivator functions is included in the insulation material to prevent the copper from breaking down the insulation. However, when the insulation is exposed to some filling materials, the amount of stabilizer in the insulation is reduced by extraction or by reaction. Also, in addition, the interaction of the reaction products of the blowing agent with the stabilization system may reduce the effectiveness of the stabilization system. Because of its relatively small size, a 26 gauge DEPIC is the most vulnerable to these problems.

Figure 3:
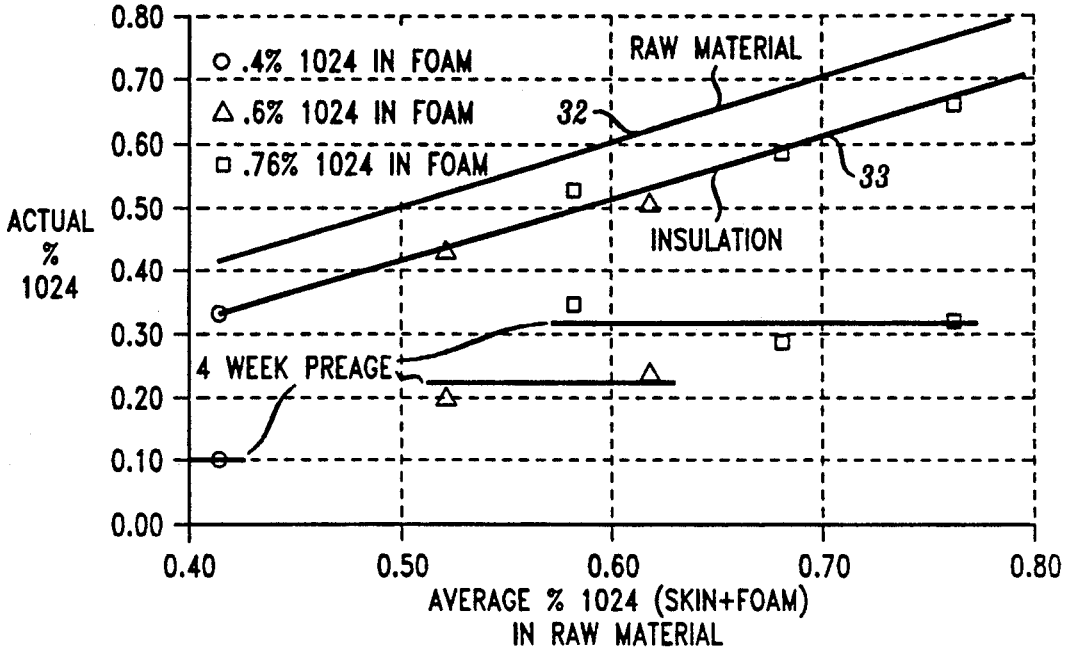
FIG. 3 is a graph which depicts levels of a bifunctional stabilizer in insulation after processing and preaging as a function of the average weight percent of the bifunctional stabilizer in the skin and in the foam in the raw material stage.

Tests were conducted at various concentrations levels of the stabilizer system. As seen in FIG. 3 a curve 32 depicts a calculated average weight percent of bifunctional stabilizer present in the raw material, skin and foam, in a 50:50 ratio. A curve 33 depicts the actual average bifunctional stabilizer after the raw material has been applied to the copper conductor as measured by high performance liquid chromatography (HPLC). Then the insulated conductor is preaged for four weeks in the presence of a filling material. For a four-week preage, it can be seen that the residual amount of bifunctional stabilizer is independent of the original amount of bifunctional stabilizer in the skin layer and dependent on that in the foam layer. As the level in the foam layer increases, the residual amount increases.

One measure of the degree of stability in a polyolefin plastic material is a parameter known as the oxidative induction time (OIT), at an elevated test temperature. ASTM procedures specify the elevated test temperature as 199° C. whereas the Rural Electrical Association (REA) specifies 199° C. for solid polyolefins and 190° C. for expanded polyolefins. See ASTM D 4565. OIT is an indication as to how well stabilized is a material by measuring how long the material will resist oxidation at a test temperature without degrading in the presence of pure oxygen. The higher the OIT, the better the stability.

Before the OIT test is performed, it is commonplace in the industry to preage the test cable for two weeks at 70° C. to facilitate permeation of the insulation with the filling material. Such preaging is believed to simulate the experience of the cable in a reel yard of a manufacturer as it awaits shipment and installation.

Figure 4:
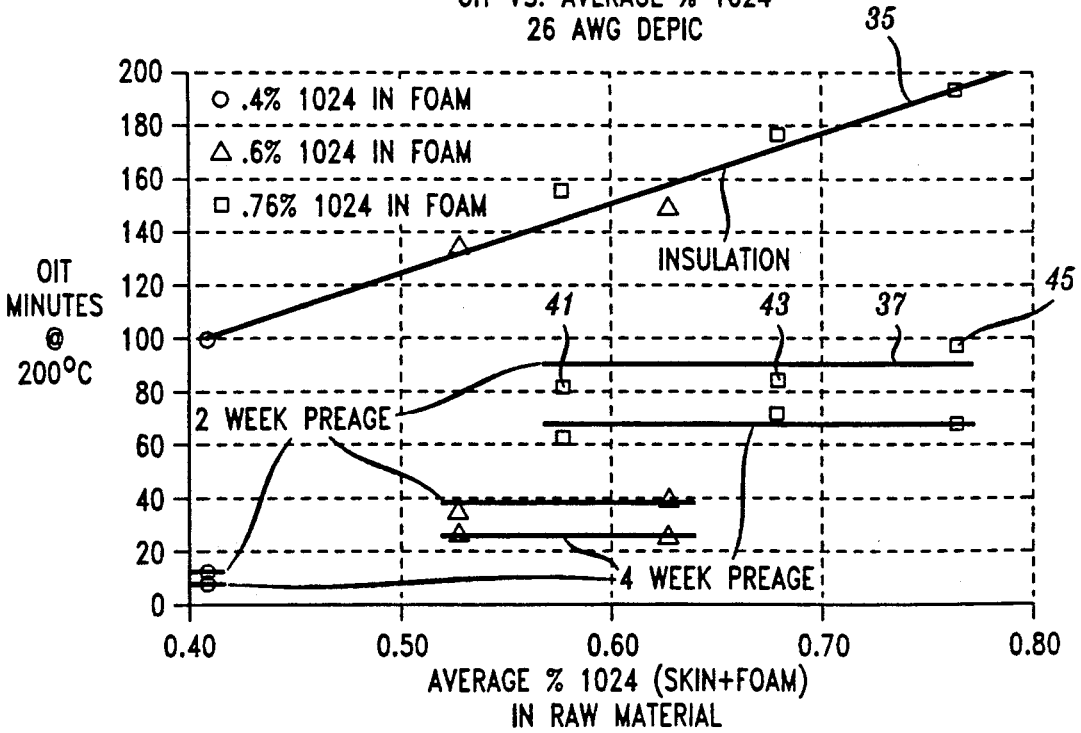
FIG. 4 is a graph which depicts oxidation induction time as a function of the average weight percent of a bifunctional stabilizer in raw materials for the foam and the skin layers.

Going now to FIG. 4, there is shown a curve 35 which plots OIT in minutes at 200° C. versus the average amount of Irganox MD 1024 bifunctional stabilizer in the raw materials for the insulation system comprising a cellular inner layer and a solid outer layer. The average level of the bifunctional stabilizer ranges from about 0.4 to 0.8 percent by weight. As is seen, the OIT increases as the average stabilizer level increases.

In FIG. 4 also is depicted a curve 37 which shows the OIT for an insulation which has been preaged for two weeks in a cable structure which included a filling material, more particularly a Flexgel filling material. The curve designated 37 represents an insulation system in which the bifunctional stabilizer level in the cellular inner layer is about 0.8% by weight whereas the bifunctional stabilizer level for the skin varies. A system shown by the numeral 41 represents a solid or skin layer having a stabilization level of about 0.4% by weight. Numerals 43 and 45 represent insulation systems having values of about 0.6 and 0.8 bifunctional stabilizer levels in the skin.

It has been known that a decrease in OIT will result from a decrease in stabilization level. However, what has not been known and what is shown in FIG. 4 is that the level of stability of the insulation system after exposure to cable filling material is determined by the weight percent of the stabilizer in the cellular layer and is independent of the level of stabilizer in the skin.

Another test which is used to test oxidative stability is the so-called pedestal test. See Bellcore Technical Reference TR-NWT-00421 Issue Sep. 3, 1991. Whereas the hereinbefore described OIT test is a quick test, the pedestal test is a long term test. It is precisely referred to as the Pedestal Thermal Oxidative Stability Performance Test. The Pedestal Thermal Oxidative Stability Performance Test is an accelerated test intended to simulate exposure of the insulated conductors to field conditions.

The cable to be tested is conditioned at an elevated temperature prior to the thermal oxidative stability test. Individual conductors are then removed from the preconditioned cable, wiped and stressed by wrapping them around a mandrel whose diameter equals the outer diameter of the insulated conductor. The stressed conductors are exposed at an elevated temperature in telephone pedestals for a specific time period (e.g., 90° C., 260 days). At the end of this period, the insulation on the conductors is examined for cracking.

For the test, a standard 6 inch (152 mm) square metal pedestal 48 inches (1.2 m) long is preferred. All internal terminal plates, polyethylene liners, frames, grounding wire, etc., which are not necessary to support wire samples may be removed. Metal brackets may be installed for mounting wire samples and monitoring probes. A heat source tightly surrounds the upper 12 inches of the pedestal.

The base of the pedestal may be plugged with cotton or cheesecloth to reduce the temperature gradient inside the pedestal. The use of R11 fiberglass/rockwood house insulation around the test pedestal beneath a heating mantle is found to reduce significantly the temperature gradient inside the pedestal. A temperature control system capable of maintaining the temperature of all the insulated conductor coils inside the pedestal within ±2° C. of the specified test temperature is used. In the case of a 90° C. test, the temperature range (absolute) will be 88° C. to 92° C. A separate system capable of monitoring and permanently recording internal temperature at intervals not to exceed four hours is used.

For testing, a finished cable, 25 pair or larger, that includes the smallest size conductors available is used. A 30 inch (762 mm) length of cable is cut from the length of cable and each end sealed with vinyl tape or capped. The sealed cable is placed in an oven at 70° C. (158° F.) for 28 days. At the end of the conditioning period, the samples are cooled to room temperature and 50 insulated conductors (5 samples of each color) are selected. If filled cable is used, each conductor is wiped with a clean cotton cloth or paper towel. No solvent is used to remove the filler. Each conductor is wrapped in 10 close turns around the mandrel starting 13 inches from one end of each of the 50 conductors. To minimize the variation of stresses developed during winding, the angle of the wire with the mandrel is maintained greater than 70 degrees. The mandrel is moved slidably out of the coiled area without disturbing the circular configuration of the wrapped conductor.

Each coiled conductor sample is attached to the metal bracket so as to form an inverted U-shaped loop whose coil apex is at the same level as the monitoring temperature sensor located 3 to 6 inches (76 to 152 mm) from the top inside surface of the pedestal. The monitoring temperature sensor is placed in the middle of the conductor coils at the top of the inverted loop and secured to the pedestal or bracket. It is important that the sensor be on the same horizontal level as the topmost coil and that all coils vary not more than ±2° C. of the specified temperature.

A probe mounted vertically with its tip upwards and located at the same height as the lowest coil is required to verify periodically or continuously that the temperature of the lowest coil remains with ±2° C. of the specified temperature. The control probe is mounted to the wall of the pedestal at the same height as the monitoring temperature sensor, or at the center axis of the pedestal at the same height. A high temperature cutoff system is used to prevent the sample loss and the nonconformity caused by an over temperature condition. It is recommended that the temperature cutoff probe be positioned adjacent to the temperature monitoring sensor at the topmost coil.

With all coils and sensors in place, the front cover of a pedestal is secured and the heating mantle is placed over the pedestal. Samples are tested at 90° C. (194° F.) temperature for 260 days.

The test is completed after heating for the specified duration of test. The duration is adjusted for any period the samples are not at the specified temperature, such as during observation time or power failure. All insulated conductor coils are maintained at 90°±2° C. (194°±4° F.) during the aging for 260 days. For an insulation system to pass, not more than one insulation sample shall show any visible cracking when examined under 5× magnification after completion of the above test temperature. Testing also is carried out at 110° C. to accelerate testing and to obtain results more quickly.

Figure 5:
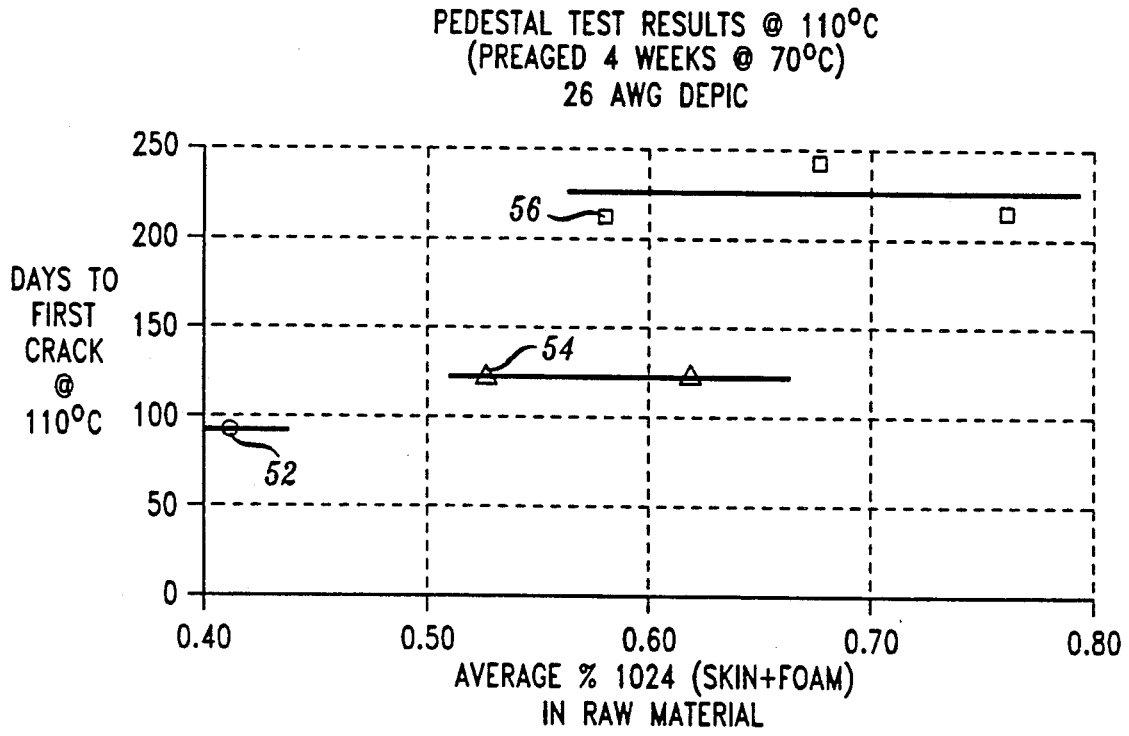
FIG. 5 is a graph which depicts the results of a pedestal test.

Going now to FIG. 5, there is shown a plot of days to first crack at 110° C. versus the average amount of 1024 stabilizer (in weight percent) in the raw material stage in the skin and in the foam layers. As can be seen, data points 52—52 and 54—54 represent a conductor having about 0.4% and 0.6%, respectively, of bifunctional stabilizer in the foam. As the weight percent of the bifunctional stabilizer in the foam increases, the number of days to first crack increases. For a conductor having about 0.8% of stabilizer in the foam as represented by data points 56—56, about 210 to 245 days expired before first cracks were noticed. These data show that the weight percent of bifunctional stabilizer in the foam layer determines the performance of the composite foam/skin insulation in the pedestal test and, as evidenced by the horizontal lines in FIG. 5, the performance is independent of the weight percent of stabilizer in the skin.

From these results, it may be concluded that the stabilization level in the cellular layer is determinative. In order to prevent cracking of the insulation, a level of bifunctional stabilizer at least about 0.4% by weight and preferably in the range of 0.4 to 0.8% by weight which is enhanced over that used on the prior art is needed in the inner, cellular layer.

This result fiies in the face of normal accepted practice in the industry in which the amount of stabilizer in the inner layer has been relatively low and about the same as in the skin layer. Over the years, the level of the bifunctional stabilizer in the cellular layer and in the skin layer gradually increased from about 0.1% to about 0.2% by weight. What has been found is that the stability of the insulation is independent of the amount of the weight percent stabilizer in the skin.

Returning now to FIG. 1, the description of the cable of which a plurality of the insulated conductors forms a core will now be completed. Disposed about the tubular member 31 is a shielding system which includes an aluminum inner shield 61. The aluminum inner shield is wrapped about the tubular member 31 to form a longitudinal overlapped seam 63. About the inner shield 61 is disposed a steel outer shield 65 which has a longitudinally extending overlapped seam 67. Typically, the overlapped seams 63 and 67 are offset circumferentially. The plastic jacket 23 is in engagement with an outer surface of the steel outer shield 65. Of course, in order to provide access to the insulated conductors to carry out splicing operations, for example, the sheath system is removed from an end portion of the cable in a closure or in a pedestal.

It is to be understood that the above-described arrangements are simply illustrative of the invention. Other arrangements may be devised by those skilled in the art which will embody the principles of the invention and fall within the spirit and scope thereof.

It is claimed:

1. A communications cable, which includes:

a core comprising a plurality of insulated conductors, each said insulated conductor comprising:

a longitudinally extending metallic conductor;

an inner layer of cellular insulation material, said inner layer including a stabilizer system which includes an antioxidant function and a metal deactivator function; and an outer layer of insulation material, said outer layer of insulation material including a stabilizer system which includes an antioxidant function, and said inner and outer layers each including each including at least a portion which has a relatively high resistance to extraction, the weight percent of the stabilizer system in said inner layer being substantially greater than that of the stabilizer system in said outer layer; and a sheath system which is disposed about said core, said sheath system comprising:

a tubular member in which are disposed said plurality of insulated conductors;

a shielding system which is disposed about said tubular member; and a plastic jacket which encloses said shielding system.

2. The cable of claim 1, which also includes a filling material.

3. A communications cable, which includes:

a core comprising a plurality of insulated conductors, each said insulated conductor comprising:

a longitudinally extending metallic conductor;

an inner layer of cellular insulation material; and an outer layer of solid insulation material, said inner layer and said outer layer of insulation material each including a stabilizer system which includes a bifunctional portion that functions as an antioxidant and as a metal deactivator and that has a relatively high resistance to extraction, the weight percent of said bifunctional portion in said outer layer being substantially less than the level of said bifunctional portion in said inner layer; and a sheath system which is disposed about said core, said sheath system comprising:

a tubular member in which are disposed said plurality of insulated conductors;

a shielding system which is disposed about said tubular member; and a plastic jacket which encloses said shielding system.

4. The communications cable of claim 3, wherein said level of said bifunctional portion of said stabilizer system in said inner layer of said insulation system is at least about 0.4% by weight.

5. The communications cable of claim 3, wherein said level of said bifunctional portion of said stabilizer system in said inner layer of said insulation system is in the range of 0.4 to 0.8% by weight.

6. The communications cable of claim 3, wherein said inner layer of cellular insulation material comprises a polyolefin plastic material.

7. The communications cable of claim 3, wherein said outer layer of insulation of each said insulated conductor comprises a polyolefin plastic material.

8. The communications cable of claim 3, wherein said inner layer comprises a plastic material which has been expanded by azodicarbonamide.

9. The cable of claim 3, which also includes a filling material.

10. The cable of claim 9, wherein said filling material comprises a hydrocarbon based material.

11. The cable of claim 9, wherein said filling material is selected from the group consisting of an oil extended rubber composition and a composition comprising petroleum jelly containing polyethylene.

12. The cable of claim 9, wherein said level of said bifunctional portion of said stabilizer system in said inner layer of said insulation system portion of said stabilizer system in said inner layer of said insulation system is at least about 0.4% by weight.

13. The cable of claim 12, wherein said level of said bifunctional portion of said stabilizer in said inner layer is in the range of 0.4 to 0.8% by weight.

14. The cable of claim 9, wherein said inner layer of cellular insulation material comprises a plastic material which has been selected from the group consisting of high density polyethylene and polypropylene.

15. The cable of claim 9, wherein said inner layer comprises a plastic material which has been expanded by azodicarbonamide.

16. An insulated conductor, which comprises:

a longitudinally extending metallic conductor;

an inner layer of cellular insulation material, said inner layer including a stabilizer system which includes an antioxidant function and a metal deactivator function; and an outer layer of insulation material, said outer layer of insulation material including a stabilizer system which includes an antioxidant function, and said inner and outer layers each including at least a portion that has a relatively high resistance to extraction, the weight percent of the stabilizer system in said outer layer being substantially less than that of said stabilizer system in said inner layer.

17. An insulated conductor, which comprises:

a longitudinally extending metallic conductor;

an inner layer of cellular insulation material; and an outer layer of solid insulation material, said inner and said outer layer of insulation material each including a stabilizer system which includes a bifunctional portion that functions as an antioxidant and as a metal deactivator and that has a relatively high resistance to extraction, the weight percent of said bifunctional portion in said outer layer being substantially less than the weight percent of said bifunctional portion in said inner layer.

18. The insulated conductor of claim 17. wherein said level of said bifunctional portion of said stabilizer system in said inner layer is at least about 0.4% by weight.

19. The insulated conductor of claim 17, wherein said level of said bifunctional portion of said stabilizer system in said inner layer is in the range of 0.4 to 0.8% by weight.

20. The insulated conductor of claim 17, wherein said inner layer and said outer layer each comprises a polyolefin plastic material.

21. The insulated conductor of claim 17, wherein said inner layer comprises a polyolefin plastic material which has been expanded by azodicarbonamide.

* * * * *